US006722501B2

(12) United States Patent
Hamerski et al.

(10) Patent No.: US 6,722,501 B2
(45) Date of Patent: Apr. 20, 2004

(54) PACKAGE ASSEMBLIES WITH ATTACHMENT STRIPS

(75) Inventors: Michael D. Hamerski, Township of Baldwin, WI (US); Ronald C. Johansson, Stillwater, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 229 days.

(21) Appl. No.: 10/083,091

(22) Filed: Feb. 26, 2002

(65) Prior Publication Data

US 2003/0159961 A1 Aug. 28, 2003

(51) Int. Cl.[7] ..... B65D 73/00

(52) U.S. Cl. ..... 206/460; 206/449; 206/831; 156/313; 248/205.3; 220/481

(58) Field of Search ..... 206/460, 425, 206/449, 494, 813, 831; 156/313, 598; 248/205.1, 205.3, 207, 683; 220/476, 480, 481

(56) References Cited

U.S. PATENT DOCUMENTS

| | | | | |
|---|---|---|---|---|
| 2,990,950 A | | 7/1961 | Alexander | |
| 3,333,686 A | | 8/1967 | Schnabel | |
| 5,409,189 A | | 4/1995 | Luhmann Lühmann | |
| 5,507,464 A | | 4/1996 | Hamerski et al. | |
| 5,630,546 A | * | 5/1997 | Velch | 248/205.3 |
| 5,695,061 A | * | 12/1997 | Stompe | 206/449 |
| 5,979,699 A | | 11/1999 | Simpson | |
| 6,120,867 A | | 9/2000 | Hamerski et al. | |
| 6,264,032 B1 | * | 7/2001 | Hobbs | 206/449 |
| 6,494,424 B1 | * | 12/2002 | Dickie et al. | 248/205.3 |
| 6,520,367 B1 | * | 2/2003 | Piroch | 220/481 |

FOREIGN PATENT DOCUMENTS

| | | |
|---|---|---|
| DE | 36 33 522 A1 | 4/1988 |
| DE | 299 19 243 U1 | 2/2000 |
| EP | 0 997 512 A2 | 5/2000 |
| FR | 1.601.230 | 8/1970 |
| WO | WO 95/06691 | 3/1995 |
| WO | WO 98/21285 | 5/1998 |

* cited by examiner

*Primary Examiner*—Luan K. Bui
(74) *Attorney, Agent, or Firm*—William L. Huebsch

(57) ABSTRACT

A package assembly including a housing that has an attachable portion and a manually removable portion. Also included is a length of attachment strip material having opposite major surfaces defined by stretch release adhesive extending between its opposite ends. The length of attachment strip material has a first part adhered along the outer surface of the attachable portion of the housing, and a second part extending from one end of the first part; and that second part of the length of attachment strip material is disposed to restrict adhesion between it and a planar surface to which the first part of the length of attachment strip material is adhered to support the housing along that surface. The manually removable portion of the housing is manually removable from the attachable portion of the housing to afford stretching of the first part of the length of attachment strip material by pulling its second part away from its first part, thereby removing the first part of the attachment strip material from between the attachable portion of the housing and that surface.

17 Claims, 9 Drawing Sheets

PACKAGE ASSEMBLIES WITH ATTACHMENT STRIPS

FIELD OF THE INVENTION

The present invention relates to package assemblies including attachment strips comprising stretch release adhesive by which the package assemblies may be temporarily adhered to surfaces.

BACKGROUND

Package assemblies are known that include attachment strips comprising stretch release adhesive such as the attachment strips commercially available from Minnesota Mining and Manufacturing Company, St. Paul, Minn., under the trade designation "Command (trade mark) Adhesive", and described in U.S. Pat. No. 6,403,206 (Bries et al) filed Sep. 20, 1994, or the corresponding International Published Application WO 95/06691. Using such an attachment strip a housing of one of the package assemblies can be adhered to a surface so that articles can then be removed from the package assembly. Then, when subsequently desired, the attachment strip can be stretched to remove it from between the housing and the surface. Generally, that attachment strip comprises a stretchable laminate including a central layer of polymeric foam (e.g., polyolefin foam), and two layers of stretchable polymeric film (e.g., polyethylene or polypropylene film, with linear low density and ultra linear low density polyethylene film being preferred) bonded along opposite major surfaces of the layer of foam. The attachment strip also includes two layers of stretch release adhesive on opposite sides of that stretchable laminate, both of which layers are spaced from one end of the stretchable laminate so that the portion of the stretchable laminate extending beyond the two layers of adhesive forms a tab that can be manually engaged to stretch the attachment strip. One of the layers of stretch release adhesive can be adhered to the housing of the package assembly, and the other to a surface (e.g., a planar vertical surface of a wall) to which it is to be adhered so that the package assembly is supported along that surface by the attachment strip. When that attachment strip is then sequentially stretched by manually pulling on the tab portion, the layers of stretch release adhesive will release from both the housing and the surface so that the package assembly can be separated from the surface. While such attachment strips are very useful and effective for releasably adhering the package assembly along a surface, they are more expensive than may be desired for use on certain types of package assemblies, particularly those that are inexpensive and/or may be used for only a short time, such as package assemblies including discount coupons dispensed at the point of sale, such as in an isle of a grocery store, or including facial or cleaning tissues or the like. That expense of the attachment strips arises, at least in part, from the procedures needed during manufacturing of the attachment strips to leave the non-adhesive coated tab portion of the attachment strips and the manner (i.e., typically manual) by which such attachment strips are applied to the housing.

DISCLOSURE OF THE INVENTION

The present invention provides a package assembly including an attachment strip comprising stretch release adhesive that can have the attachment and release properties described above for the attachment strip commercially available from Minnesota Mining and Manufacturing Company, St. Paul, Minn., under the trade designation "Command (trade mark) Adhesive", but which attachment strip is significantly less expensive to manufacture and to apply to a housing of the package assembly than the prior art attachment strip described above.

The present invention also provides a method for forming a plurality of such package assemblies comprising the steps of (1) providing an elongate supply of the attachment strip material having opposite major surfaces entirely defined by stretch release adhesive (i.e., the elongate supply length of attachment strip material can be in a roll); (2) forming walls into a plurality of housings so that each of the housings has an attachable portion and a manually removable portion (e.g., by forming lines of weakness (score lines or rows of perforations) in each of the housings to define the portions); (4) applying a predetermined length of the attachment strip material to each of the housings by adhering a first part of the predetermined length along the outer surface of the attachable portion of the housing with a second part of the predetermined length extending from one end of the first part; and (5) providing for each of the package assemblies means for restricting adhesion between the second part of the length of attachment strip material and a planar support surface when the first part of the length of attachment strip material is adhered along the planar support surface. The first part of the length of attachment strip material on each housing can be adhered to a planar support surface (e.g., typically a vertical surface) to support the housing along the surface. When, subsequently, it is desirable to remove the housing from that surface, the removable portion of the housing can be manually separated from the attachable portion of the housing to afford manual stretching of the first part of the length of attachment strip material by engagement with the second part to remove the first part of the length of attachment strip material from between the attachable portion of the housing and the planar support surface.

The attachable portion of each housing can include a first wall (included in the walls forming the housing) to which the first part of the length of attachment strip material is attached, and can further include a portion of a second wall included in the walls forming the housing; and the second part of the length of attachment strip material can be adhered to the manually removable portion of the housing which can be formed from a portion of that second wall by providing the lines of weakness in the second wall between the manually removable and attachable portions of the housing. The first and second walls can be disposed at an angle (e.g., a right angle) with respect to each other to provide at least a portion of the means for restricting adhesion between the second part of the length of attachment strip material and a planar support surface when the first part of the length of attachment strip material is adhered along the planar support surface. The second part of the length of attachment strip material can be adhered along an inner surface or along the outer surface of the manually removable portion of the housing. If it is adhered along the outer surface of the manually removable portion of the housing its adhesive surface can remain exposed, or can be covered by a protective layer. For example, a protective layer of thin flexible material can be applied around the housing and the applied length of attachment strip material, and a separable portion of that layer can be adhered to the second part of the length of attachment strip material on its surface opposite the manually removable portion of the housing. That separable portion will remain adhered to the second part of the length of attachment strip material after the rest of the protective layer of thin flexible material is removed.

Alternatively, the attachable portion of each of the housings can be a first portion of a first wall included in the walls forming the housing to which first portion the first part of the length of attachment strip material is attached, and that first wall can also include a second portion aligned with the first portion and included in the removable portion of the housing, with the first and second portions of the first one of the walls being joined along a line of weakness to afford, after the removable portion of the housing is manually removed from its attachable portion, manual stretching of the first part of the length of attachment strip material by engagement with the second part to remove the first part of the length of attachment strip material from between the attachable portion of the housing and the planar support surface to remove the attachable portion of the housing from that surface. The second part of the length of attachment strip material can be adhered along an inner surface of the manually removable portion of the housing or along its outer surface where its adhesive surface can be covered by a protective layer to provide the means for restricting adhesion between the second part of the length of attachment strip material and a planar support surface when the first part of the length of attachment strip material is adhered along the planar support surface. For example, a protective layer of thin flexible material with a separable portion can be adhered to the second part of the length of attachment strip material as was described above.

As a further option, the attachable portion of each of the housings can include a first part to which the first part of the length of attachment strip material is adhered, and that attachable portion of the housing can further include a second part co-extensive with the second part of the length of attachment strip material to which the second part of the length of attachment strip material is adhered, which second part of the attachable portion of the housing is separable from its first part to afford, after the removable portion of the housing is manually removed from its attachable portion, manual stretching of the first part of the length of attachment strip material by engagement with its second part to remove the first part of the attachment strip material from between the attachable portion of the housing and the planar support surface.

As yet a further option the attachable portion of the housing can include a first wall having opposite front and rear surfaces, the first part of the length of attachment strip material can be adhered to the rear surface of the first wall; the manually removable portion of the housing can be a minor portion of the first wall along its front surface; and the second part of the length of attachment strip material can extend around an edge of the first wall be adhered to the manually removable portion of said housing, thereby providing at least a portion of the means for restricting adhesion between the second part of the length of attachment strip material and a planar support surface to which it is attached.

Also optionally the attachable portion can be a first portion of a first wall included in the walls forming the housing to which first portion of the first wall the first part of the length of attachment strip material is adhered, a second portion of the first wall can be included in the removable portion of the housing, the second part of the length of attachment strip material can be adhered to a second wall included in the manually removable portion of the housing with the first and second walls being disposed at about a right angle with respect to each other to provide at least a portion of the means for restricting adhesion between the second part of the length of attachment strip material and a planar support surface to which it is attached.

The attachment strip used in the package assembly according to the present invention can be a length of attachment strip material having the structure of the attachment strips described in U.S. Pat. No. 6,403,206 (Bries et al) described above, except that two layers of stretch release adhesive on opposite sides of that stretchable laminate extend entirely between the opposite ends of the length and the attachment strip includes no portions having surfaces not defined by adhesive that form a manually engagaeble tab. Such attachment strip material can be made in a long supply length for less cost than making the prior art attachment strips described above because there is no need to leave portions of the stretchable laminate without adhesive coating to provide the tab.

Alternatively, the attachment strip used could consist of two layers of adhesive that define the major adhesive surfaces adhered along opposite major surfaces of a single layer of stretchable polymeric film, or could be similar to the attachment strip described in U.S. Pat. No. 5,409,189 (Luhmann), which attachment strip would consist of a single layer of pressure sensitive adhesive that would define the two major adhesive surfaces, but would have no polymeric film covering over its end portion to provide non-sticky surfaces for its tab portion by which its layer of pressure sensitive adhesive could be stretched to cause it to release from surfaces between which it has been adhered.

BRIEF DESCRIPTION OF THE DRAWINGS

The present invention will be further described with reference to the accompanying drawing wherein, like parts are identified with like reference numerals in the several views, and wherein.

DETAILED DESCRIPTION OF THE INVENTION

Figure 1:
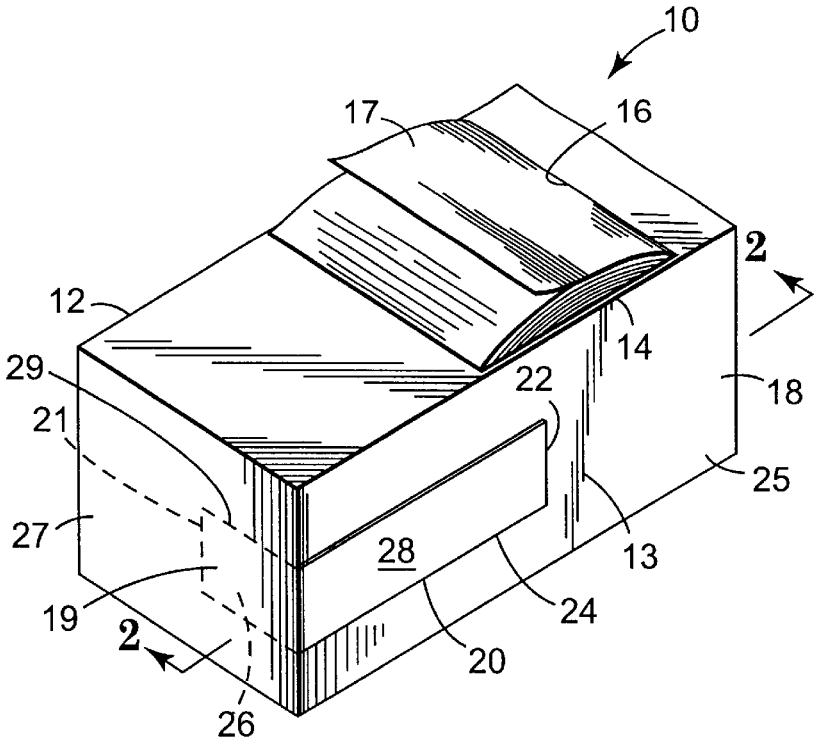
FIG. 1 is a perspective view of a first embodiment of a package assembly according to the present invention.
Figure 2:
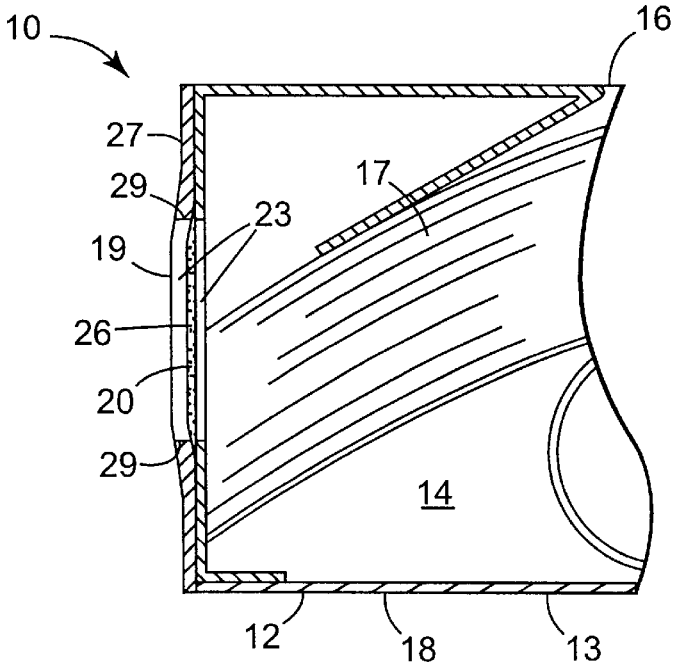
FIG. 2 is an enlarged fragmentary sectioned view taken approximately along line 2—2 of FIG. 1.

Referring now to FIGS. 1 and 2 of the drawing there is illustrated a first embodiment of a package assembly according to the present invention generally designated by the reference numeral 10. Generally, the package assembly 10 comprises walls forming a housing 12 similar to the housing described in U.S. Pat. No. 5,979,699, the content whereof is incorporated herein by reference. The housing 12 has an outer surface 13, and an inner surface 14 defining a cavity in which items 17 (e.g., discount coupons or sheets) may be stored and from which those items 17 may be removed through an opening 16 in the housing 12. The housing 12 includes an attachable portion 18, (which is a major portion of the housing 12), and a manually removable portion 19 (which is a minor portion of the housing 12). Also included in the package assembly 10 is a length 20 of attachment strip material having opposite ends 21 and 22, and opposite major surfaces defined by stretch release adhesive extending between its opposite ends 21 and 22. The length 20 of attachment strip material has a first major part 24 adhered along the outer surface 13 of a first wall 25 included in the attachable portion 18 of the housing 12, and a second minor part 26 extending from one end of the first part 24, which second part 26 is positioned along and adhered to an inner surface of the manually removable portion 19 of the housing 12. The manually removable portion 19 of the housing 12 is a minor portion of a second wall 27 included in the walls forming the housing 12, with a major portion of that second wall 27 being included in the attachable portion 18 of the housing 12. The manually removable portion 19 of the housing 12 is removeably attached to that major portion of the second wall 27 by lines of weakness 29 (e.g., score lines or rows of perforations). The first and second walls 25 and 27 are disposed at an angle (i.e., about a right angle) with respect to each other. A release liner 28 extends along a major surface of the first part 24 of the length 20 of attachment strip material, which major surface is opposite the major surface of the first part 24 that is adhered to the attachable portion 18 of the housing 12. That release liner 28 is removable to afford adhering the first part 24 of the length 20 of attachment strip material to a planar support surface (e.g., the vertical surface of a wall or display shelf) to support the housing 12 along that surface. When all of the items 17 have been removed from the housing 12, or when it is otherwise desirable to remove the housing 12 from such a support surface to which it was adhered, the manually removable portion 19 of the housing 12 can be manually removed from the attachable portion 18 of the housing 12 by breaking the second wall 27 along the lines of weakness 29 around the manually removable portion 19. Such removal affords manual stretching of the first part 24 of the length 20 of attachment strip material to remove it from between the attachable portion 18 of the housing 12 and that support surface to which it was adhered by pulling the removable portion 19 of the housing 12 (and thereby the second part 26 of the length 20 of attachment strip material that is adhered to the removable portion 19 of the housing 12) away from the first part 24 of the length 20 of attachment strip material to stretch and thereby release the adhesion of that first part 24 from the support surface and from the attachable portion 18 of the housing 12.

As is seen in FIG. 2, the second part 26 of the length 20 of attachment strip material is positioned and adhered between two layers of material (e.g., two layers of chipboard) that form the second wall 27 including the manually removable portion 19 of the housing 12 so that those layers of material prevent contact with the second part 26 of the length 20 of attachment strip material either by the items 17 in the housing 12 or by a person contacting the outer surface 13 of the housing 12. Also, the housing 12 has a slit 23 between the end of the manually removable portion 19 and the first wall 25 which facilitates removing the removable portion 19 from the rest of the second wall 27 so that the manually removable part 19 can be pulled away from the first part 24 of the length 20 of attachment strip material.

Figure 3:
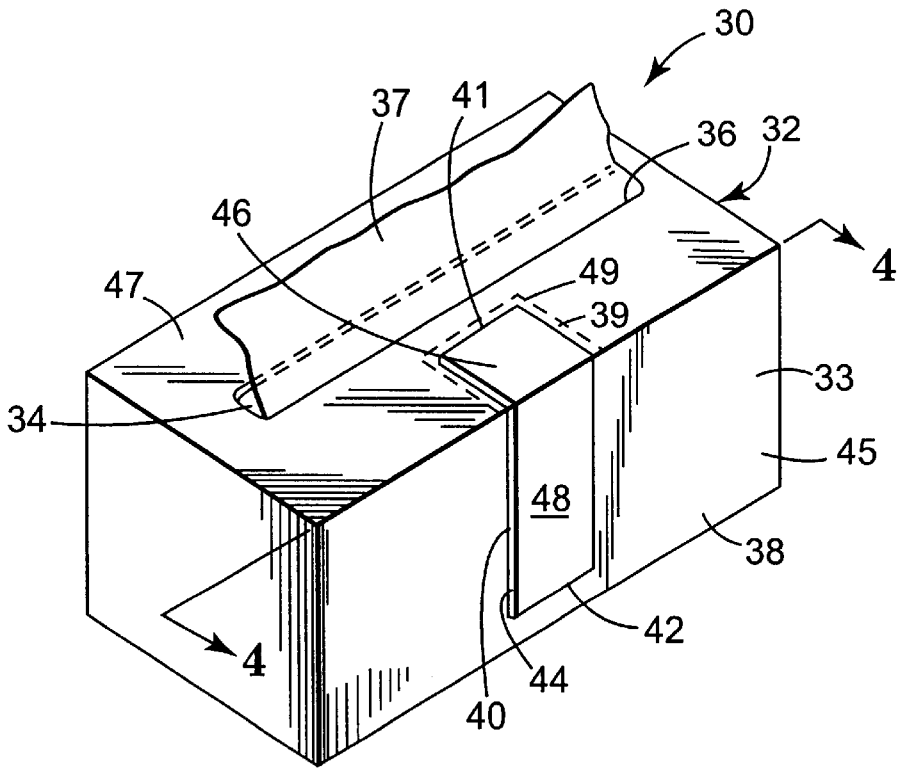
FIG. 3 is a perspective view of a second embodiment of a package assembly according to the present invention.
Figure 4:
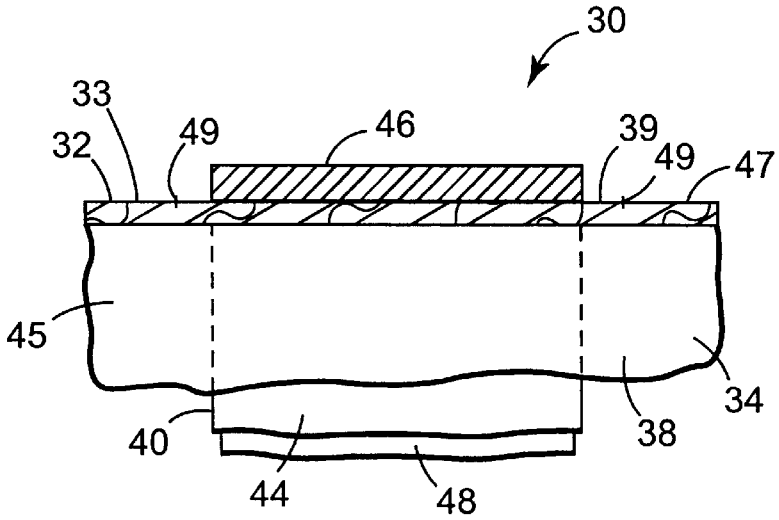
FIG. 4 is an enlarged fragmentary sectioned view taken approximately along line 4—4 of FIG. 3.

Referring now to FIGS. 3 and 4 of the drawing there is illustrated a second embodiment of a package assembly according to the present invention generally designated by the reference numeral 30. Generally, the package assembly 30 comprises walls forming a housing 32 having an outer surface 33, and an inner surface 34 defining a cavity in which items 37 (e.g., cleaning tissues) may be stored and from which those items 37 may be removed through an opening 36 in the housing 32. The housing 32 includes an attachable portion 38, (which is a major portion of the housing 32), and a manually removable portion 39 (which is a minor portion of the housing 32). Also included in the package assembly 30 is a length 40 of attachment strip material having opposite ends 41 and 42, and opposite major surfaces defined by stretch release adhesive extending between its opposite ends 41 and 42. The length 40 of attachment strip material has a first major part 44 adhered along the outer surface 33 on a first wall 45 included in the attachable portion 38 of the housing 32, and a second minor part 46 extending along and adhered along the outer surface 33 on the manually removable portion 39 of the housing 32. The manually removable portion 39 of the housing 32 is a minor portion of a second wall 47 included in the walls forming the housing 32, with a major portion of that second wall 47 being included in the attachable portion 38 of the housing 32. The manually removable portion 39 of the housing 32 is attached to that major portion of the second wall 47 by lines of weakness 49 (e.g., score lines or rows of perforations). The housing 32 can have a slit between the end of the manually removable portion 39 and the first wall 45 to facilitate removing the removable portion 39 from the rest of the second wall 47. The first and second walls 45 and 47 are disposed at an angle (i.e., about a right angle) with respect to each other which provides at least a part of means for restricting adhesion between the second part 46 of the length 40 of attachment strip material and a planar support surface when the first part 44 of the length 40 of attachment strip material is adhered along that planar support surface. A release liner 48 extends along a major surface of the first part 44 of the length 40 of attachment strip material, which major surface is opposite the major surface of the first part 44 that is adhered to the attachable portion 38 of the housing 32. That release liner 48 is removable to afford adhering the first part 44 of the length 40 of attachment strip material to a support surface (e.g., the planer vertical surface of a wall or cabinet) to support the housing 32 along that surface. When all of the items 37 have been removed from the housing 32, or when it is otherwise desirable to remove the housing 32 from a support surface to which it has been adhered by the length 40 of attachment strip material, the manually removable portion 39 of the housing 32 can be manually removed from the attachable portion 38 of the housing 32 by breaking the second wall 47 along the lines of weakness 49 around the manually removable portion 39. Such removal affords manual stretching of the first part 44 of the length 40 of attachment strip material to remove it from between the attachable portion 38 of the housing 32 and that support surface to which it was adhered by pulling the removable portion 39 of the housing 32 and the second part 46 adhered to it away from the first part 44 of the length 40 of attachment strip material to stretch and thereby release the adhesion of that first part 44 from the support surface and from the attachable portion 38 of the housing.

As is seen in FIG. 4, the housing 32 can be of corrugated cardboard, and the manually removable portion 39 of the housing 32 can be only a portion of the outer layer of that cardboard that is attached to the major portion of the outer layer of that second wall 47 along lines of weakness 49 around the second part 46 of the length 40 of attachment strip material. That portion of the outer layer of the cardboard within the lines of weakness 49 can be pealed away from the rest of the cardboard (including portions of the cardboard underlying it) with the second part 46 of the length 40 of attachment strip material to afford manual engagement of the second part 46 of the length 40 of attachment strip material and thereby stretching of the first part 44 of the length 40 of attachment strip material to remove the attachable portion 40 of the housing 32 from that surface to which it was adhered. Alternatively, the housing 32 can be of chip board which is embossed, cut, or perforated partially through its thickness to form lines of weakness 49 around the second part 46 of the length 40 of attachment strip material so that the manually removable portion 39 of the housing 32 is only the portion of the outer clay coated layer of that chipboard within the lines of weakness 49. That outer layer of the chipboard within the lines of weakness 49 can be pealed away from the underlying fibrous layer or layers of the housing with the second part 46 of the length 40 of attachment strip material to afford manual engagement of the second part 46 of the length 40 of attachment strip material and thereby stretching of the first part 44 of the length 40 of attachment strip material to remove the attachable portion 40 of the housing 32 from that surface to which it was adhered.

Figure 5:
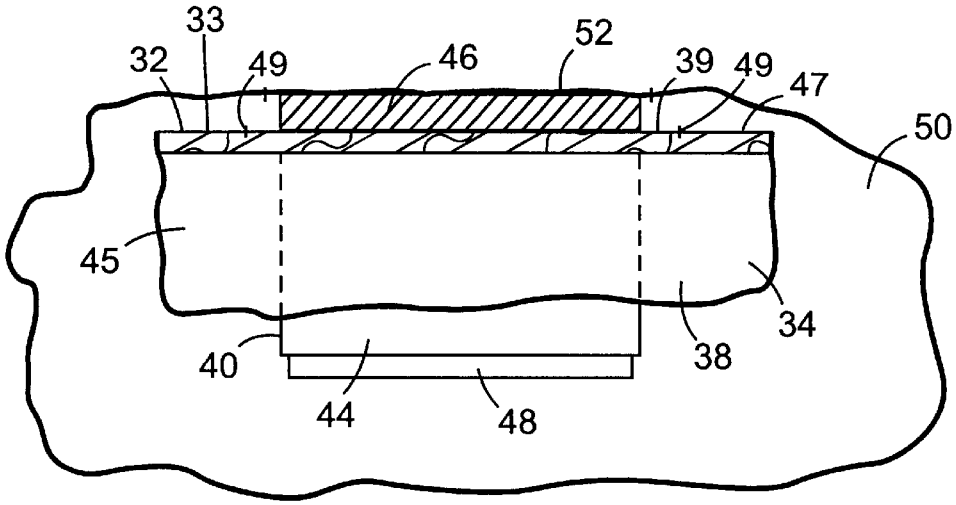
FIG. 5 is a fragmentary sectioned view similar to FIG. 4 that illustrates a modification of the package assembly illustrated in FIGS. 3 and 4.

As illustrated in FIGS. 3 and 4, the outer adhesive surface of the second part 46 of the length 40 of attachment strip material can be exposed. Alternatively, a layer of material can be adhered over that outer adhesive surface of the second portion 46, or, as illustrated in FIG. 5, the package assembly 30 can further include a removable protective layer 50 of flexible polymeric material (e.g., PVC, polyethylene, or cellophane) around the housing 32 and the length 40 of attachment strip material. That removable protective layer 50 of flexible material can include a separable portion 52 adhered along the surface of the second part 46 of the length 40 of attachment strip material opposite the manually removable portion 39 of the housing 32.

Figure 6:
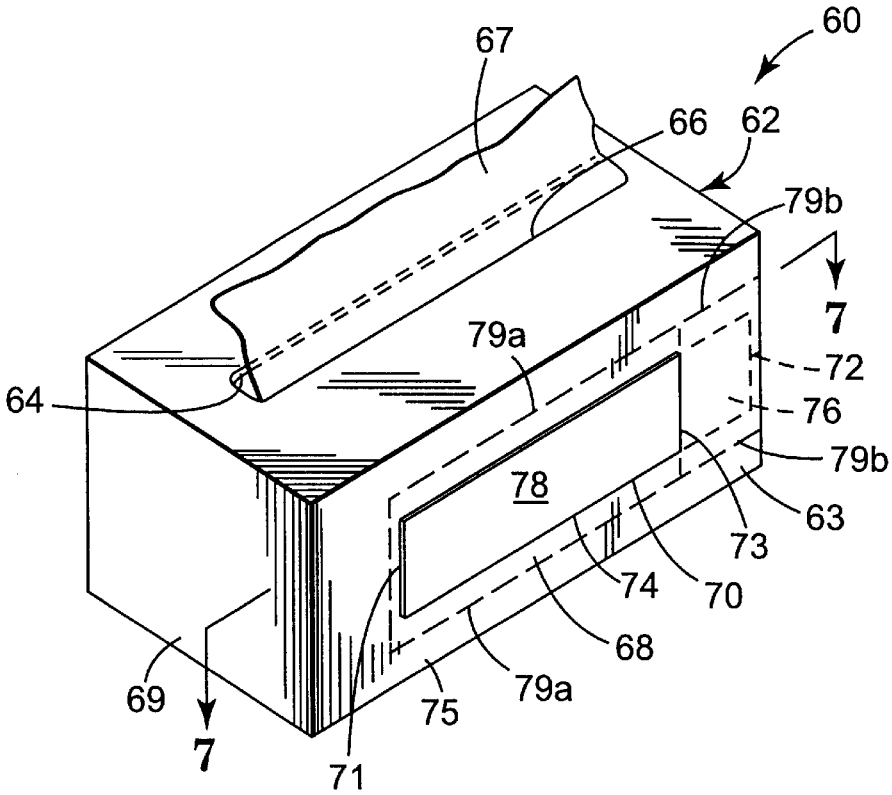
FIG. 6 is a perspective view of a third embodiment of a package assembly according to the present invention.
Figure 7:
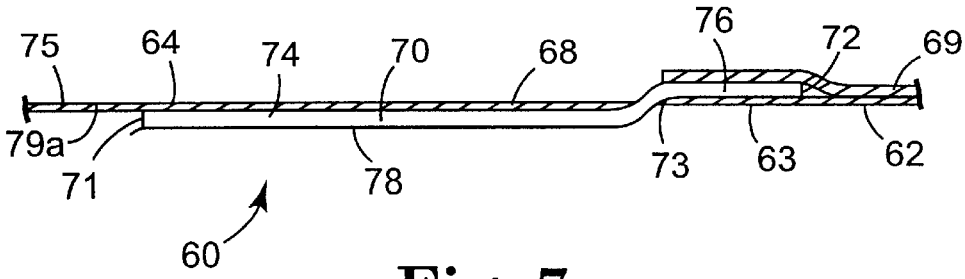
FIG. 7 is an enlarged fragmentary sectioned view taken approximately along line 7—7 of FIG. 6.
Figure 8:
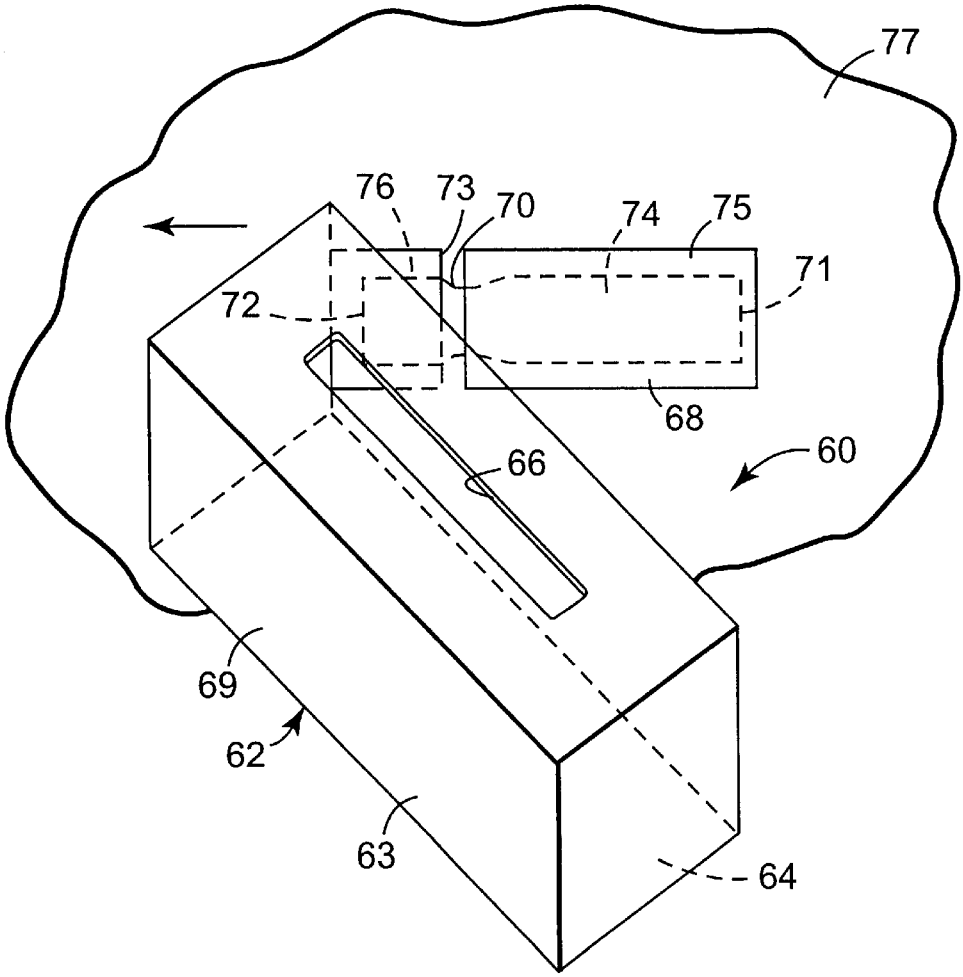
FIG. 8 is a perspective view of the package assembly of FIG. 6 illustrating a step used in removing the package assembly from a surface to which the package assembly has been attached.

Referring now to FIGS. 6, 7, and 8 of the drawing there is illustrated a third embodiment of a package assembly according to the present invention generally designated by the reference numeral 60. Generally, the package assembly 60 comprises walls forming a housing 62 having an outer surface 63, and an inner surface 64 defining a cavity in which items 67 (e.g., facial tissues) may be stored and from which those items 67 may be removed through an opening 66 in the housing 62. The housing 62 includes an attachable portion 68 which is a minor portion of the housing 62 and a first portion of a first wall 75 included in the walls forming the housing 62. The housing also includes a manually removable portion 69 which is a major portion of the housing 62 and includes, together with all the walls forming the housing 62 other than the first wall 75, a second portion of the first wall 75 that is aligned with the portion of the first wall 75 forming the attachable portion 68 of the housing 62. That second portion of the first wall 75 is attached to the attachable portion 68 of the housing along a line of weakness 79 (e.g., score lines or rows of perforations) in the first wall 75 to afford manual removal of the removable portion 69 of the housing 62 from the attachable portion 68 of the housing 62 by breaking the first wall 75 along that line of weakness 79. Also included in the package assembly 60 is a length 70 of attachment strip material having opposite ends 71 and 72, and opposite major surfaces defined by stretch release adhesive extending between its opposite ends 71 and 72. The length 70 of attachment strip material has a first major part 74 adhered along the outer surface 63 of the attachable portion 68 of the housing 62 that extends through a slot 73 in the first wall 75, and has a second minor part 76 extending along and adhered to an inner surface of the manually removable portion 69 of the housing 62 to provide means for restricting adhesion between the second part 76 of the length 70 of attachment strip material and a planar support surface when the first part 74 of the length 70 of attachment strip material is adhered along that planar support surface. A release liner 78 extends along a major surface of the first part 74 of the length 70 of attachment strip material, which major surface is opposite the major surface of the first part 74 that is adhered to the attachable portion 68 of the housing 62. That release liner 78 is removable to afford adhering the first part 74 of the length 70 of attachment strip material to a surface (e.g., the planar vertical surface of a wall or cabinet, such as the surface 77 illustrated in FIG. 8) to support the housing 62 along that surface. When all of the items 67 have been removed from the housing 62, or when it is otherwise desirable to remove the housing 62 from a support surface such as the support surface 77 to which it has been adhered by the length 70 of attachment strip material, the manually removable portion 69 of the housing 62 can be manually removed from the attachable portion 68 of the housing 62 by breaking the first wall 75 along the lines of weakness 79*a* around the attachable portion 68, and along the lines of weakness 79*b* extending from the attachable portion 68 to the edge of the first wall 75 on opposite sides of the second part 76 of the length 70 of attachment strip material. This allows movement of the major part of the manually removable portion 69 of the housing 62 away from the support surface 77 as illustrated in FIG. 8 and manual engagement with the part of the manually removable portion 69 of the housing 62 to which the second part 76 of the length 70 of attachment strip material is adhered to pull that second part 76 away from the first part 74, thereby stretching and releasing the adhesion of that first part 74 from the support surface 77 and the attachable portion 68 so that the attachable portion 68 can be removed from the support surface 77.

As is seen in FIG. 7, the second portion 76 of the length 70 of attachment strip material is positioned between two layers of material (e.g., two layers of chipboard) that form a portion of the first wall 75 included in the manually removable portion 69 of the housing 62 so that those layers of material prevent contact with the second portion 76 of the length 70 of attachment strip material either by the items 67 in the housing 62 or by a person contacting the outer surface 63 of the housing 62.

Alternately, the second part 76 of the length 70 of attachment strip material could be adhered to the outer surface of the portion of the first wall 75 included in the manually removable portion 69 of the housing 62, and a layer of material could be adhered over that outer adhesive surface of the second part 76, or, as was illustrated in FIG. 5 and described above for the package assembly 30, the package assembly 60 could further include a removable protective layer of flexible material (e.g., PVC, polyethylene, or cellophane) around the housing 62 and the length 70 of attachment strip material (not illustrated), which removable layer of flexible material could include a separable portion adhered along the surface of the second part 76 of the length 70 of attachment strip material opposite the manually removable portion 69 of the housing 62.

Figure 9:
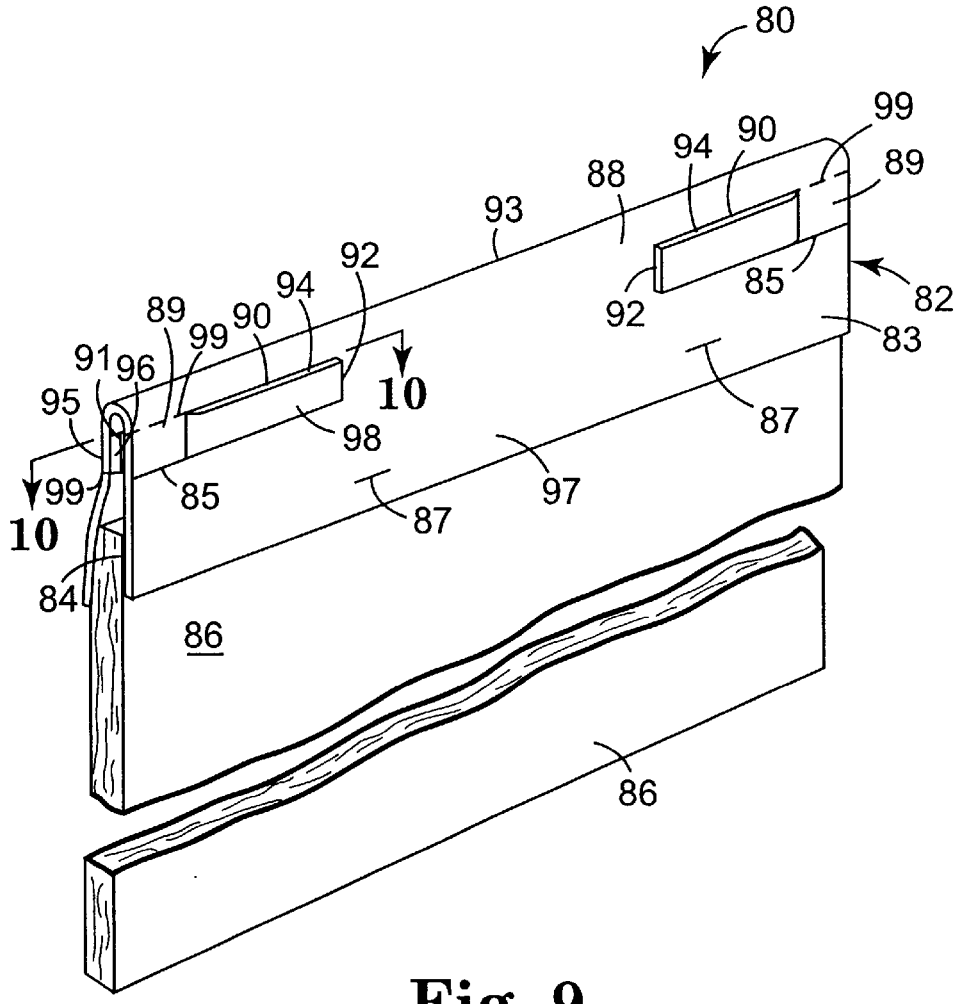
FIG. 9 is a perspective view of a fourth embodiment of a package assembly according to the present invention.
Figure 10:
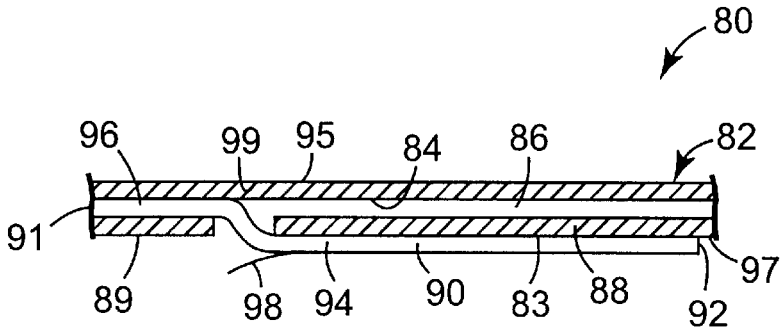
FIG. 10 is an enlarged fragmentary sectioned view taken approximately along line 10—10 of FIG. 9.

Referring now to FIGS. 9 and 10 of the drawing there is illustrated a fourth embodiment of a package assembly according to the present invention generally designated by the reference numeral 80. Generally, the package assembly 80 comprises first and second or front and rear walls 95 and 97 joined along one edge 93 to form a housing 82 having an outer surface 83, and an inner surface 84 defining a cavity. End portions of items or sheets 86 of paper in a stack are positioned and held in that cavity as by adhesive and/or staples 87 so that portions of those sheets 86 of paper projecting from the housing 82 can be removed from the stack (e.g., a calendar or the large "Post it" brand note pad commercially available from Minnesota Mining and Manufacturing Company, St. Paul, Minn., under the trade designation "Post-it (trade mark) EASEL PAD # 556). The housing 82 includes an attachable portion 88, (which is a major portion of the housing 82), and two manually removable portions 89 (which are minor portions of the housing 82). Also included in the package assembly 80 are two lengths 90 of attachment strip material each having opposite ends 91 and 92, and opposite major surfaces defined by stretch release adhesive extending between its opposite ends 91 and 92. Each length 90 of attachment strip material has a first major part 94 adhered along the outer surface 83 of the portion of the rear or second wall 97 included in the attachable portion 88 of the housing 82, and a second minor part 96 extending along and adhered to the inner surfaces of one of the manually removable portions 89 of the housing 82. That adhesion to those inner surfaces provides at least a part of means for restricting adhesion between the second parts 96 of the lengths 90 of attachment strip material and a planar support surface when the first parts 94 of the lengths 90 of attachment strip material are adhered along that planar support surface. Each manually removable portion 89 of the housing 82 includes minor portions of the first and second walls 95 and 97 adhered to opposite surfaces of one of the minor parts 96. The manually removable portions 89 of the housing 82 are removeably attached to the major portion of the housing 82 by lines of weakness 99 (e.g., score lines or rows of perforations) therebetween. L-shaped slots 85 can be formed in the second or rear wall 97 so that the portions thereof included in the manually removable portions 89 of the housing 82 can be lifted out of the plane of that rear wall 95 during manufacture of the package assembly 80 to facilitate applying the lengths 90 of attachment strip material to the housing 82, after which those portions of the rear wall 95 can be pressed against and adhered to the minor parts 96 of the lengths 90 of attachment strip material. A release liner 98 extends along a major surface of the first part 94 of each of the lengths 90 of attachment strip material opposite the major surface of that first part 94 adhered to the attachable portion 88 of the housing 82. That release liner 98 is removable to afford adhering the first part 94 of the length 90 of attachment strip material to a surface (e.g., the vertical surface of a wall or cabinet) to support the housing 82 along that surface. When all of the major portions of the sheets 86 have been removed from the portions of the sheets 86 retained in the housing 82, or when it is otherwise desirable to remove the housing 82 from a support surface to which it has been adhered by the lengths 80 of attachment strip material, the manually removable portions 89 of the housing 82 can be manually removed from the attachable portion 88 of the housing 82 by breaking the first and second walls 95 and 97 along the lines of weakness 99 around the manually removable portions 89. The manually removable portions 89 of the housing 82 to which the second parts 76 of the lengths 70 of attachment strip material are adhered can then be pulled away from the first parts 74, thereby stretching and releasing the adhesion of those first parts 74 from the support surface and the attachable portion 88 so that the attachable portion 88 can be removed from the support surface.

Figure 11:
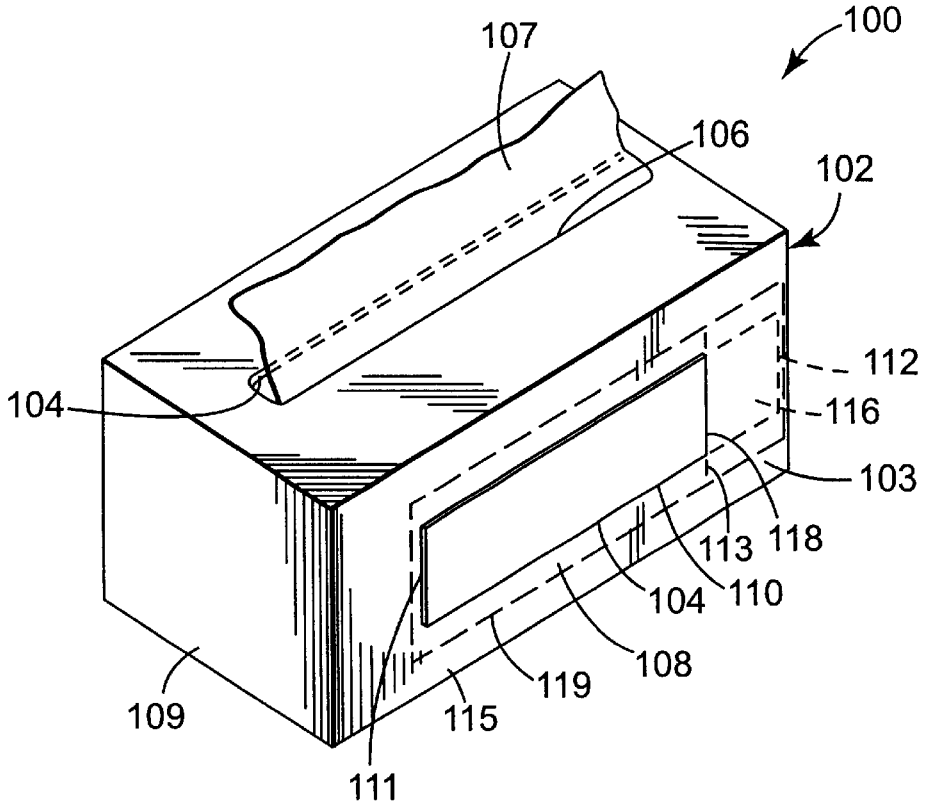
FIG. 11 is a perspective view of a fifth embodiment of a package assembly according to the present invention.
Figure 12:
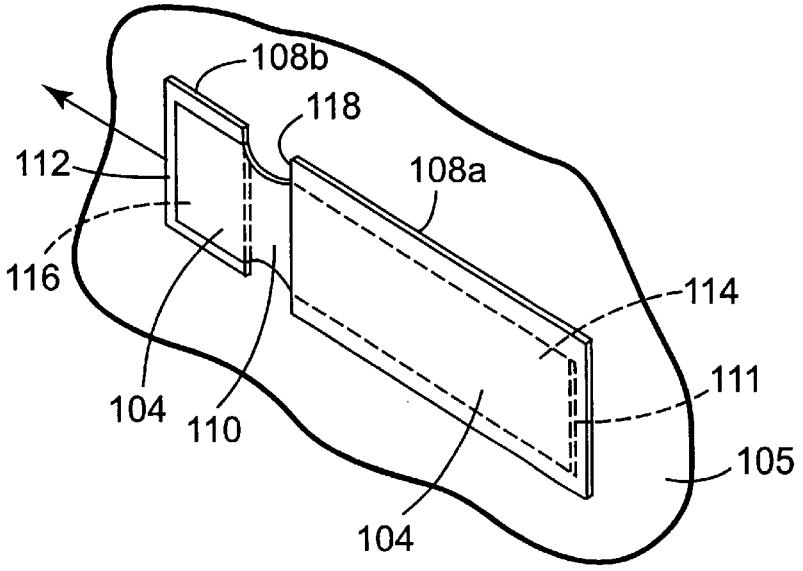
FIG. 12 is a perspective view of an attachable portion of the package assembly of FIG. 11 after a removable portion of that package assembly has been removed, which view illustrates removing the attachable portion from a surface to which the package assembly has been attached.

Referring now to FIGS. 11 and 12 of the drawing there is illustrated a fifth embodiment of a package assembly according to the present invention generally designated by the reference numeral 100. Generally, the package assembly 100 comprises walls forming a housing 102 having an outer surface 103, and an inner surface 104 defining a cavity in which items 107 (e.g., facial tissues) may be stored and from which those items 107 may be removed through an opening 106 in the housing 102. The housing 102 includes an attachable portion 108 which is a minor portion of the housing 102 and as illustrated is a first portion of a first wall 115 included in the walls forming the housing 102 (alternatively the attachable portion 108 could be the entire first wall 115). The housing 102 also includes a manually removable portion 109 which is a major portion of the housing 102 and includes, together with all the walls forming the housing 102 other than the first wall 115, a second portion of the first wall 115 that is aligned with the portion of the first wall 115 forming the attachable portion 108 of the housing 102. That second portion of the first wall 115 is attached to the attachable portion 108 of the housing 102 along a line of weakness 119 (e.g., score lines or rows of perforations) in the first wall 115 to afford manual removal of the removable portion 109 of the housing 102 from the attachable portion 108 of the housing 102 by breaking the first wall 115 along that line of weakness 119. The attachable portion 108 of the housing 102 is separated into a first major part **108*a* and a second minor part 108*b* by a line of weakness 113 that includes a central slot 118. Also included in the package assembly 100 is a length 110 of attachment strip material having opposite ends 111 and 112, and opposite major surfaces defined by stretch release adhesive extending between its opposite ends 111 and 112. The length 110 of attachment strip material includes a first major part 114 adhered along the outer surface 103 of the first part 108*a* of the attachable portion 108 of the housing 102, extends through the slot 118 in the line of weakness 113, and includes a second minor part 116 extending along and adhered to an inner surface of the second part 108*b* of the attachable portion 108 of the housing 102 to provide means for restricting adhesion between the second part 116 of the length 110 of attachment strip material and a planar support surface when the first part 114 of the length 110 of attachment strip material is adhered along that planar support surface. A release liner (not shown) can extend along a major surface of the first part 114 of the length 110 of attachment strip material opposite the major surface of the first part 114 that is adhered to attachable portion 108 of the housing 102. That release liner would be removable to afford adhering the first part 114 of the length 110 of attachment strip material to a surface (e.g., the planar vertical surface of a wall or cabinet) to support the housing 102 along that surface. When all of the items 107 have been removed from the housing 102, or when it is otherwise desirable to remove the housing 102 from a support surface such as the support surface 105 to which it has been adhered by the length 110 of attachment strip material, the manually removable portion 109 of the housing 102 can be manually removed or pulled away from the attachable portion 108 of the housing 102 to break the first wall 115 along the lines of weakness 119 around the attachable portion 108. This then allows manual engagement with the part 108***b* of the attachable portion 108 of the housing 102 to which the second part 116 of the length 110 of attachment strip material is adhered to pull that second part 108*b* away from the first part 108*a*, thereby stretching and releasing the adhesion of the first part 114 of the length 110 of attachment strip material from between the support surface 105 and the second part 108*b* of the attachable portion 108 so that the attachable portion 108 is removed from the support surface 105.

The second part 116 of the length 110 of attachment strip material can be positioned along the inner surface of the second part 108*b* of the attachable portion 108 of the housing 102 as illustrated, or alternatively can be positioned between two layers of material (e.g., two layers of chipboard) that form the second part 108*b* of the attachable portion 108 of the housing 102 so that those layers of material prevent contact with the second part 116 of the length 110 of attachment strip material either by the items 107 in the housing 102 or by a person contacting the outer surface 103 of the housing 102.

Also alternately, the second part 116 of the length 110 of attachment strip material could be adhered to the outer surface of the second part 108*b* of the attachable portion 108 of the housing 102, and a layer of material could be adhered over that outer adhesive surface of the second part 116, or, as was illustrated in FIG. 5 and described above for the package assembly 30, the package assembly 100 could further include a removable protective layer of flexible material (e.g., PVC, polyethylene, or cellophane) around the housing 102 and the length 110 of attachment strip material (not illustrated), which removable layer of flexible material could include a separable portion adhered along the surface of the second part 116 of the length 110 of attachment strip material opposite the second part 108*b* of the attachable portion 108 of the housing 102.

Figure 13:
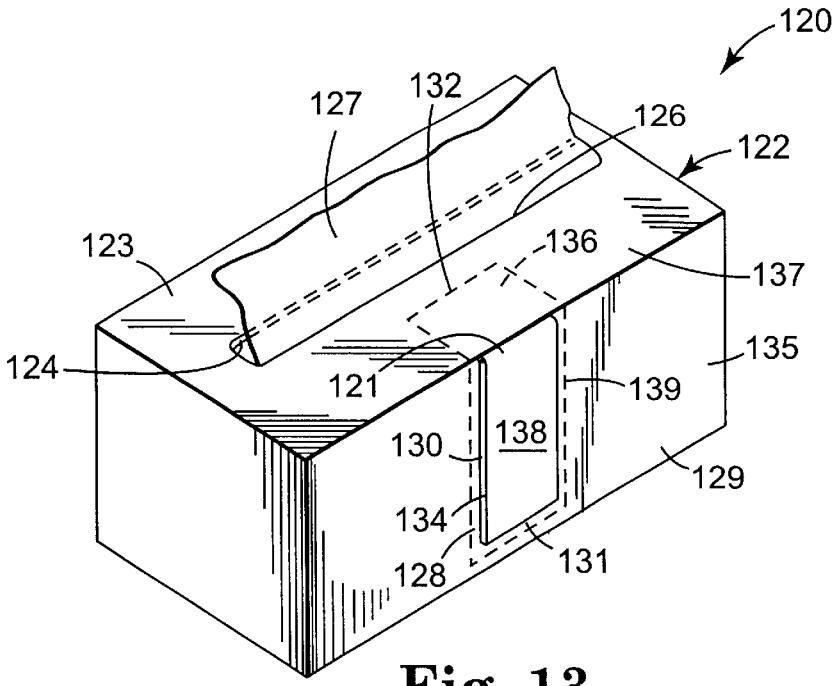
FIG. 13 is a perspective view of a sixth embodiment of a package assembly according to the present invention.
Figure 14:
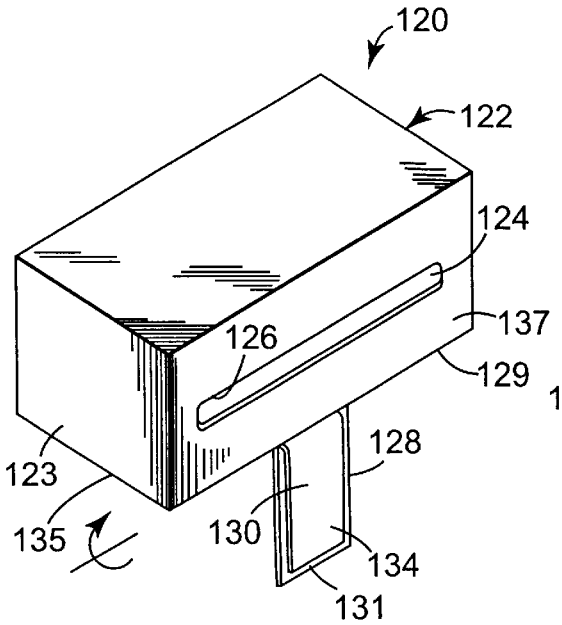
FIGS. 14 and 15 are reduced perspective views of the package assembly of FIG. 13 which illustrate sequential steps in removing the package assembly from a surface to which the package assembly has been attached.
Figure 15:
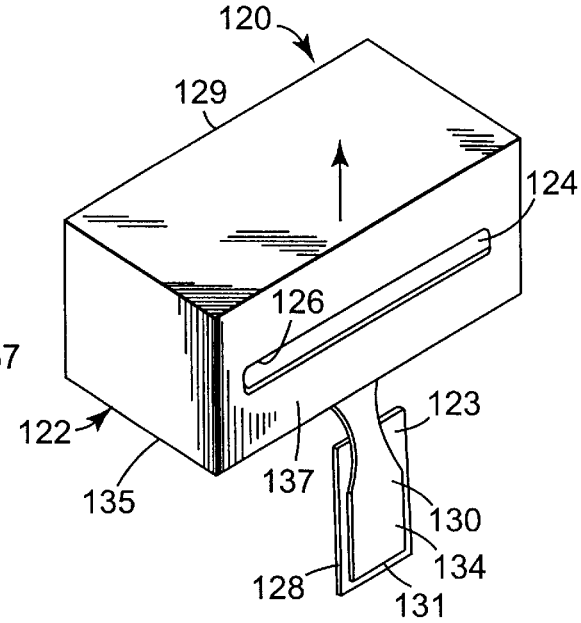

Referring now to FIGS. 13, 14, and 15 of the drawing there is illustrated a sixth embodiment of a package assembly according to the present invention generally designated by the reference numeral 120. Generally, the package assembly 120 comprises walls forming a housing 122 having an outer surface 123, and an inner surface 124 defining a cavity in which items 127 (e.g., tissues) may be stored and from which those items 127 may be removed through an opening 126 in the housing 122. The housing 122 includes an attachable portion 128, (which is a minor portion of a first wall 135 of the housing 122), and a manually removable portion 129 (which is the major portion of the first wall 135 together with the other walls forming the housing 122). Also included in the package assembly 120 is a length 130 of attachment strip material having opposite ends 131 and 132, and opposite major surfaces defined by stretch release adhesive extending between its opposite ends 131 and 132. The length 130 of attachment strip material has a first major part 134 adhered along the outer surface of the attachable portion 128 of the housing 122, extends through a slot 121 in the housing 122, and has a second minor part 136 adhered along an inner surface on a second wall 137 included in the manually removable portion 129 of the housing 122. The attachable portion 128 of the housing 122 is attached to that major portion of the first wall 135 included in the manually removable portion 129 of the housing 122 by lines of weakness 139 (e.g., score lines or rows of perforations). The second minor part 136 of the length 130 of attachment strip material being attached along an inner surface of the second wall 137 and/or the first and second walls 135 and 137 being disposed at an angle (i.e., about a right angle) with respect to each other provide means for restricting adhesion between the second part 136 of the length 130 of attachment strip material and a planar support surface when the first part 134 of the length 130 of attachment strip material is adhered along that planar support surface. A release liner 138 extends along a major surface of the first part 134 of the length 130 of attachment strip material opposite its major surface adhered to the attachable portion 128 of the housing 122. That release liner 138 is removable to afford adhering the first part 134 of the length 130 of attachment strip material to a support surface (e.g., the planer vertical surface of a wall or cabinet) to support the housing 122 along that surface. When all of the items 127 have been removed from the housing 122, or when it is otherwise desirable to remove the housing 122 from a support surface to which it has been adhered by the length 130 of attachment strip material, the manually removable portion 129 of the housing 122 can be manually removed or separated from the attachable portion 128 of the housing 122 by pivoting the removable portion 129 of the housing 122 around the intersection between the first and second walls 135 and 137 (as is illustrated in FIG. 14 which, like FIG. 15, illustrates the package assembly 120 as though it were adhered to a sheet of glass through which the package assembly is viewed) to thereby break the second wall 137 along the lines of weakness 139 around the manually removable portion 129. Then, as is illustrated in FIG. 15, the removable portion 129 of the housing 122 to which the second part 136 of the length 130 of attachment strip material is adhered can be manually lifted away from the attachable portion 128 of the housing 122 to stretch the first part 134 of the length 130 of attachment strip material, thereby releasing the adhesion of the first part 134 of the length 130 of attachment strip material from between the attachable portion 128 of the housing 122 and the support surface to which it was adhered. Stretching of the second part 136 of the length 130 of attachment strip material while it is being pulled with the removable portion 149 of the housing 122 to thus stretch and release its first part 134 can be restricted by the user pinching that second part 136 and removable portion 129 together. Alternatively, the second part 136 of the length 130 of attachment strip material could be caused to remain adhered to the housing 122 during such stretching of the first part 134 by means such as making the second part 136 wider than the first part 134, or causing the second part 136 to adhere more firmly to the housing 142 than the first part 134 by providing a layer of an appropriate adhesive between the second part 136 and the housing 122 or providing a special surface texture on the part of the housing 122 to which the second part 136 is adhered. If the second part 136 of the length 130 of attachment strip material is stretched and released from the housing 122 before the first part 134 is completely stretched and released from the substrate and the attachable portion 128 of the housing 122 when the removable portion 129 of the housing 122 is pulled away from the attachable portion 128 of the housing 122, that stretched second part 136 can then be manually grasped and pulled to complete stretching and releasing the first part 124 to remove the attachable portion 128 from the substrate.

The second part 136 of the length 130 of attachment strip material can be positioned along the inner surface of the second wall 137 or can be positioned between two layers of material (e.g., two layers of chipboard) that form the second wall 137 so that those layers of material prevent contact with the second part 136 of the length 130 of attachment strip material either by the items 127 in the housing 122 or by a person contacting the outer surface 123 of the housing 122. Also alternately, the second part 136 of the length 130 of attachment strip material could be adhered to the outer surface of the wall 137 and a layer of material could be adhered over that outer adhesive surface of the second part 136, or, as was illustrated in FIG. 5 and described above for the package assembly 30, the package assembly 120 could further include a removable protective layer of flexible material (e.g., PVC, polyethylene, or cellophane) around the housing 122 and the length 130 of attachment strip material (not illustrated), which removable layer of flexible material could include a separable portion adhered along the surface of the second part 136 of the length 130 of attachment strip material opposite the second wall 137.

Figure 16:
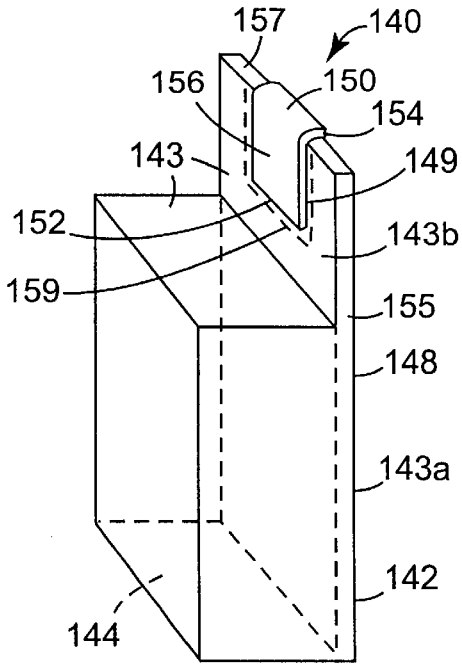
FIG. 16 is a perspective view of a seventh embodiment of a package assembly according to the present invention.
Figure 17:
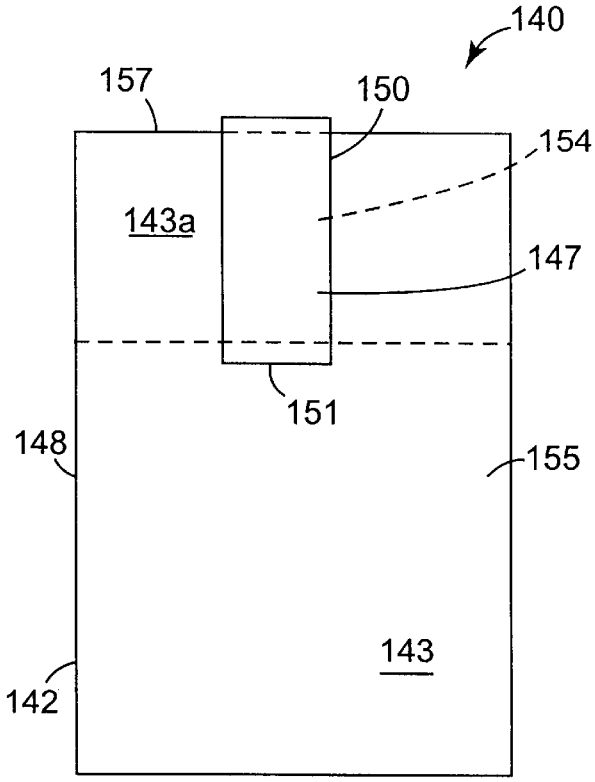
FIG. 17 is a rear view of the package assembly of FIG. 16.
Figure 18:
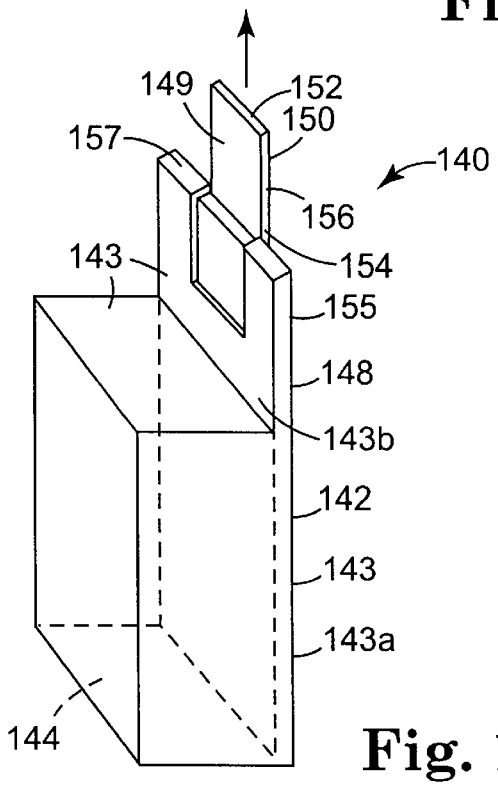
FIG. 18 is a perspective view of the package assembly of FIG. 16 which illustrates removing the package assembly from a surface to which the package assembly has been attached.

Referring now to FIGS. 16, 17, and 18 of the drawing there is illustrated a seventh embodiment of a package assembly according to the present invention generally designated by the reference numeral 140. Generally, the package assembly 140 comprises walls forming a housing 142 having an outer surface 143, and an inner surface 144 defining a cavity in which items may be stored. All of the walls could be of pasteboard, or, alternatively, some of the walls forming the housing may be of transparent polymeric material to form a housing of the type sometimes called a "blister pack" which holds products for sale and is typically hung from a commercial display rack. The housing 142 includes an attachable portion 148 (which is the major portion of the housing 142), and a manually removable portion 149 (which is a minor portion of the housing 142). Also included in the package assembly 140 is a length 150 of attachment strip material having opposite ends 151 and 152, and opposite major surfaces defined by stretch release adhesive extending between its opposite ends 151 and 152. The length 150 of attachment strip material has a first major part 154 adhered along a first or rear portion 143*a* of the outer surface 143 on a first wall 155 included in the housing, and has a second minor part 156 extending from one end of the first part 154. That second part 156 extends around an edge 157 of that first wall 155 and extends along and is adhered to a second or front outer portion 143*b* of the surface 143 on the first wall 155 that is opposite the rear portion 143*a* of the surface 143. The manually removable portion 149 of the housing 142 is a minor portion of an outer layer of the first wall 155 of the housing 142, with a major portion of that first wall 155 being included in the attachable portion 148 of the housing 142. The first wall 155 could be formed from a single layer of pasteboard, or could be formed by two layers of pasteboard joined or folded along the edge 157. The manually removable portion 149 of the housing 142 can be partially separated from that major portion of the first wall 155 by lines of weakness 159 (e.g., score lines or rows of perforations), and, if needed, a cut or slot can be provided across the end of the manually removable portion of the housing at the edge 157. The edge 157 and the second or front portion 143*b* of the outer surface 143 on the first wall 155 are disposed at angles (i.e., about 90 degree and 180 degree angles respectively) with respect to the rear portion 143*a* of the surface 143 on the first wall 155 which provides means for restricting adhesion between the second part 156 of the length 150 of attachment strip material and a planar support surface when the first part 154 of the length 150 of attachment strip material is adhered along that planar support surface. A release liner 147 extends along a major surface of the first part 154 of the length 150 of attachment strip material, which major surface is opposite the major surface of the first part 154 that is adhered to the attachable portion 148 of the housing 142. That release liner 147 is removable to afford adhering the first part 154 of the length 150 of attachment strip material to a planar support surface (e.g., the vertical surface of a wall or display shelf) to support the housing 142 along that surface. When it is desirable to remove the housing 142 from such a support surface to which it was adhered, the second part 156 of the length 150 of attachment strip material and the manually removable portion 149 of the housing to which it is adhered can be manually pulled away from the rest or major portion of the first wall 155, causing the first wall 155 to break along the lines of weakness 159. If the first wall 155 is a single layer of pasteboard, it can delaminate. If the first wall 155 is formed from two layers of pasteboard the manually removable portion can be part of only one of the layers. Such pulling away of the second part 156 and removable portion 149 affords manual pulling of the second part 156 of the length 150 of attachment strip material and the removable portion 149 of the housing 142 adhered to it away from the first part 154 of the length 150 of attachment strip material (see FIG. 18) to stretch and thereby release the adhesion of that first part 154 from the support surface and from the attachable portion 148 of the housing 142.

The second part 156 of the length 150 of attachment strip material can have a layer of material (e.g., polymeric material or paper) adhered along its outer surface to prevent contact with the second part 156 of the length 150 of attachment strip material by a person contacting the outer surface 143 of the housing 142. That layer of material could, optionally, be printed with instructions for attaching the package assembly to and/or removing the package assembly from a support surface.

When the first wall 155 is made from some types of pasteboard the perforations 159 may not be needed as the outer layer will delaminate and tear around the second part 156 of the length 150 of attachment strip material when it is lifted away from the first wall 155.

Figure 19:
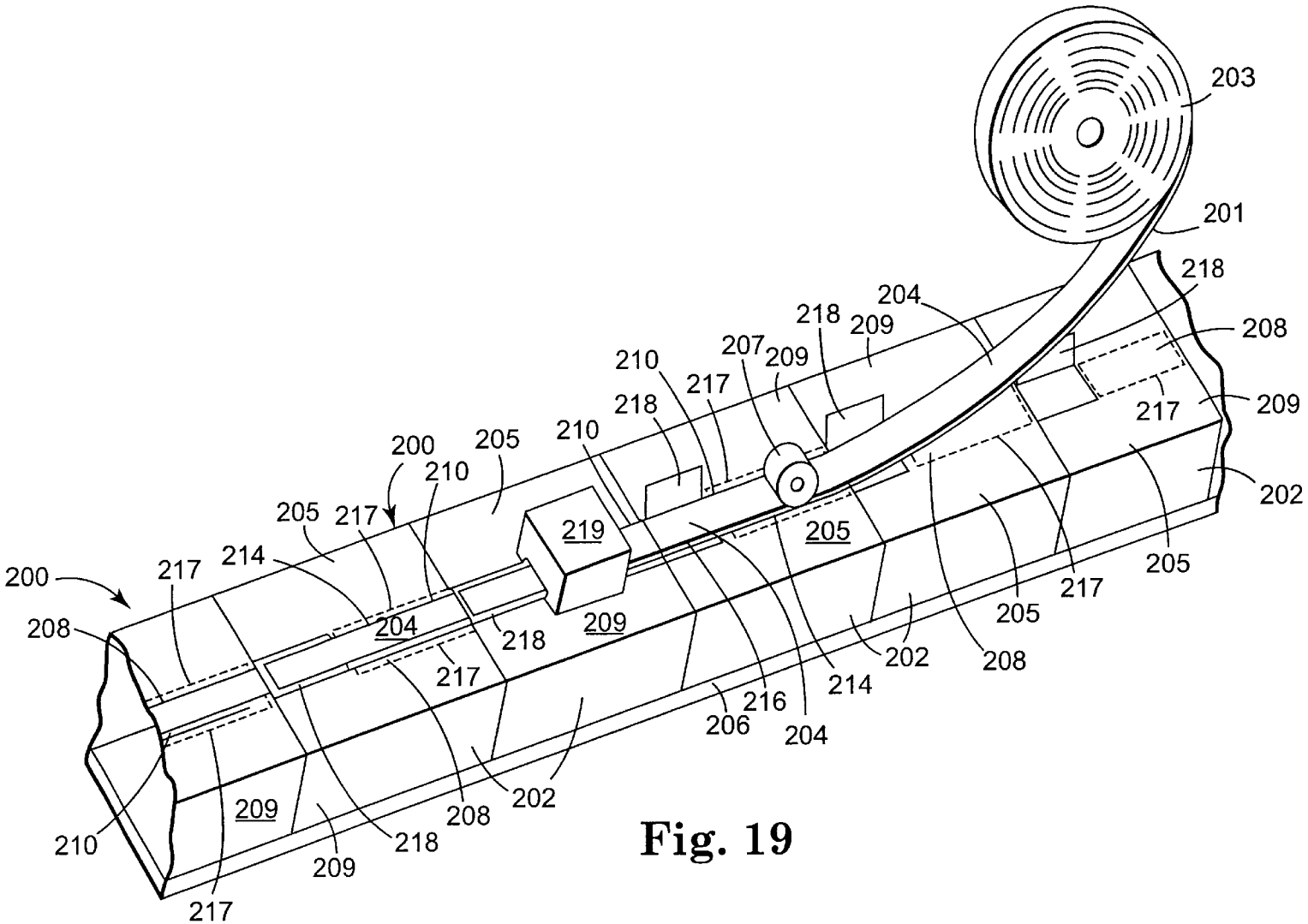
FIG. 19 is a perspective view schematically illustrating a method according to the present invention for making an embodiment of a package assembly according to the present invention that is similar to that illustrated in FIGS. 6, 7, and 8.

FIG. 19 schematically illustrates a method according to the present invention for forming a plurality of package assemblies 200 according to the present invention, each of which package assemblies 200 is similar to the package assembly 60 described above with reference to FIGS. 6 and 7. That method comprises the following steps. An elongate supply 201 of the attachment strip material is provided that has opposite major surfaces entirely defined by stretch release adhesive. The elongate supply of attachment strip material can, as illustrated, be provided in a roll 203, and has a length of release liner 204 extending along one major surface. Walls (e.g., of chipboard or cardboard are formed into a plurality of housings 202 using conventional housing or box forming machinery (not illustrated). Lines of weakness 217 (e.g., score lines or rows of perforations) are formed in each of the housings 202 to define an attachable portion 208 (which is a minor portion of the housing 202 and of one wall 205 of the housing 202) and a major manually removable portion 209 of the housing 202. The housings are positioned end to end and move along a path by a suitable conveying device 206. A predetermined length 210 of the elongate supply 201 of attachment strip material is applied to each of the moving housings 202 and pressed against that housing 202 by a roller 207. A first major part 214 of the predetermined length 210 is adhered along the outer surface of the attachable portion 208 of the housing 202, and a second minor part 216 of the predetermined length 210 extends and is adhered along the manually removable portion 209 of the housing 202. The housings 202 are initially formed with upstanding tabs 218 attached only along one side, and the second minor part 216 of the predetermined length 210 is adhered to an inner layer of each housing 202 beside its tab 218. The housings 202 then pass through a mechanism 219 that severs the elongate supply 201 of attachment strip material and the release liner 204 between the housings 202 to separate the predetermined lengths 210 between the housings 202, lifts the leading end of the release liner 204 on each predetermined length 210, presses the tab 218 against the then exposed surface of the second minor part 216 of the predetermined length 210, and then allows the leading end of the release liner 204 on each predetermined length to return to a position along the outer surface of the tab 218 where it can be grasped to manually remove the release liner 204. The tab 218 thereafter provides means for restricting adhesion between the second minor portion 216 of the predetermined length 210 of attachment strip material and a surface aligned with the first major part 214 of the predetermined length 210 of attachment strip material.

After the release liner 204 is removed, the first major part 214 of the length 210 of attachment strip material on each housing 202 can be adhered to a surface (e.g., typically a vertical surface) to support the housing 202 along that surface. When, subsequently, it is desirable to remove the housing 202 from that surface, the removable portion 209 of the housing 202 can be manually separated from the minor attachable portion 208 of the housing 202 along the lines of weakness 217 to afford manual engagement of the second minor part 216 of the length 210 of attachment strip material to stretch the first part 214 of the length 210 of attachment strip material, thereby removing the first part 214 of the length 210 of attachment strip material from between the surface and the attachable portion 208 of the housing 202.

The present invention has now been described with reference to several embodiments and modifications thereof. It will be apparent to those skilled in the art that many changes can be made in the embodiments described without departing from the scope of the present invention, and that many different types of structures or housings could be advantageously provided with one or more of the attachment strips described above. For example, boxes or housings filled with Pop-up Post-it (trade mark) notes could be provided with attachment strips in a manner similar to that described with reference to FIGS. 1 and 2. Picture frames made with backings of cardboard or similar materials could be provided with attachment strips in a manner similar to that described with reference to FIGS. 6 and 7. Calendars, signs, or store point of purchase displays could be provided with attachment strips in a manner similar to that described with reference to FIGS. 8 and 9. Thus, the scope of the present invention should not be limited to the structures described in this application, but only by the structures described by the language of the claims and the equivalents thereof

What is claimed is:

1. A package assembly comprising:

walls forming a housing having inner and outer surfaces; said walls including means for affording manual separation of said housing into an attachable portion and a manually removable portion;

a length of attachment strip material having opposite ends and opposite major surfaces defined by stretch release adhesive extending between said opposite ends, said length of attachment strip material having a first part adhered along the outer surface of said attachable portion of said housing which first part can be adhered to a planar support surface to support said housing along said support surface, and said length of attachment strip material further including a second part extending from one end of said first part; and means for restricting adhesion between said second part of said length of attachment strip material and a said planar support surface when said first part of said length of attachment strip material is adhered along the planar support surface;

said manually removable portion of said housing being manually removable from said attachable portion of said housing to afford manual stretching of the first part of the length of attachment strip material by engagement with said second part to remove the first part of the attachment strip material from between the attachable portion of the housing and the planar support surface.

2. A package assembly according to claim 1 wherein said attachable portion includes a first wall included in the walls forming the housing to which first wall the first part of the length of attachment strip material is adhered, and said attachable portion further includes a portion of a second wall included in the walls forming the housing; said manually removable portion of said housing is a portion of said second wall; said second part of said length of attachment strip material is adhered to said manually removable portion of said housing, and said first and second walls are disposed at about a right angle with respect to each other to provide at least a portion of said means for restricting adhesion between said second part of said length of attachment strip material and a said planar support surface.

3. A package assembly according to claim 2 wherein said second wall has lines of weakness between said major portion of said second wall and said manually removable portion of the housing to provide said means for affording manual separation of said housing into an attachable portion and a manually removable portion.

4. A package assembly according to claim 2 wherein said second part of said length of attachment strip material is adhered along the outer surface of said manually removable portion of the housing.

5. A package assembly according to claim 1 wherein said second part of said length of attachment strip material is adhered along the outer surface of said manually removable portion of the housing, and said package assembly further includes a removable layer of flexible material around said housing and said length of attachment strip material, said removable layer of flexible material including a separable portion adhered to the major surface along the second part of said length of attachment strip material opposite said manually removable portion of the housing to provide at least a portion of said means for restricting adhesion between said second part of said length of attachment strip material and a said planar support surface.

6. A package assembly according to claim 1 wherein said second part of said length of attachment strip material is adhered along the outer surface of said manually removable portion of the housing, and said package assembly further includes a layer of flexible material comprising a portion adhered to the major surface along the second part of said length of attachment strip material opposite said manually removable portion of the housing to provide at least a portion of said means for restricting adhesion between said second part of said length of attachment strip material and a said planar support surface.

7. A package assembly according to claim 1 wherein said second part of said length of attachment strip material is adhered along an inner surface of said manually removable portion of the housing to provide at least a portion of said means for restricting adhesion between said second part of said length of attachment strip material and a said planar support surface.

8. A package assembly according to claim 1 wherein said attachable portion of said housing is a first portion of a first wall included in the walls forming the housing; said first wall also includes a second portion aligned with said first portion of said first wall and included in said removable portion of said housing, said second portion of said first wall is attached to said first portion of said first wall along a line of weakness in said first wall to provide said means for affording manual separation of said housing into an attachable portion and a manually removable portion and after said manual separation to afford manual stretching of the first part of the length of attachment strip material by engagement with said second part to remove the first part of the attachment strip material from between the attachable portion of the housing and the planar support surface.

9. A package assembly according to claim 8 wherein said second part of said length of attachment strip material is positioned along an inner surface of said removable portion of said housing to provide said means for restricting adhesion between said second part of said length of attachment strip material and a said planar support surface.

10. A package assembly according to claim 1 wherein said attachable portion includes a first wall having opposite front and rear surfaces included in the walls forming the housing, the first part of the length of attachment strip material is adhered to the rear surface of the first wall; said manually removable portion of said housing is a portion of said first wall along said front surface; and said second part of said length of attachment strip material extends around an edge of said first wall and is adhered to said manually removable portion of said housing, thereby providing at least a portion of said means for restricting adhesion between said second part of said length of attachment strip material and a said planar support surface.

11. A package assembly according to claim 1 wherein said attachable portion of said housing includes a first part to which said first part of said length of attachment strip material is adhered, and said attachable portion of said housing further includes a second part co-extensive with said second part of said length of attachment strip material, said second part of said length of attachment strip material is adhered to said second part of said attachable portion of said housing, and said second part of said attachable portion of said housing is separable from said first part of said attachable portion of said housing to afford, upon removal of said removable portion of said housing from said attachable portion of said housing, a manual stretching of the first part of the length of attachment strip material by engagement with said second part to remove the first part of the attachment strip material from between the attachable portion of the housing and a said planar support surface.

12. A package assembly according to claim 1 wherein said attachable portion is a first portion of a first wall included in the walls forming the housing to which first portion of the first wall the first part of the length of attachment strip material is adhered, a second portion of said first wall is included in said removable portion of the housing, said second part of said length of attachment strip material is adhered to a second wall included in said manually removable portion of said housing, and said first and second walls are disposed at about a right angle with respect to each other to provide at least a portion of said means for restricting adhesion between said second part of said length of attachment strip material and a said planar support surface.

13. A method for forming a plurality of package assemblies comprising the steps of:

providing an elongate supply of attachment strip material having opposite major surfaces defined by stretch release adhesive;

forming walls into a plurality of housings so that each of the housings has inner and outer surfaces and includes an attachable portion and a manually removable portion;

applying a predetermined length of the attachment strip material to each of the housings by adhering a first part of the predetermined length along the outer surface of the attachable portion of the housing with a second part of the predetermined length extending from one end of the first part; and providing for each of the package assemblies means for restricting adhesion between the second part of the length of attachment strip material and a planar support surface when the first part of the length of attachment strip material is adhered along the planar support surface so that for each of the package assemblies the first part of the length of attachment strip material can be adhered to a said planar support surface to support the housing along the surface; and, subsequently, the removable portion of the housing can be manually removed from the attachable portion of housing to afford stretching of the first part of the length of attachment strip material by manual engagement with the second part to remove the first part of the attachment strip material from between the attachable portion of the housing and the planar support surface.

14. A method according to claim 13 wherein in said forming step each of the housings is formed to have lines of weakness between the attachable portion of the housing and the manually removable portion of the housing.

15. A method according to claim 13 wherein in said applying step the second part of the length of attachment strip material is adhered along an inner surface of the manually removable portion of the housing to provide the means for restricting adhesion between the second part of the length of attachment strip material and a planar support surface.

16. A method according to claim 13 wherein in said forming step each of the housings is formed so that the attachable portion of the housing is a first portion of a first wall included in the walls from which the housing was formed; the first wall also includes a second portion aligned with the first portion of the first wall and included in the removable portion of the housing; and the second portion of the first wall is attached to the first portion of the first wall along a line of weakness in the first wall to afford manual removal of the removable portion of the housing from the attachable portion of the housing and manual engagement of the second part of the length of attachment strip material to stretch the first part of the length of attachment strip material, thereby removing the attachable portion of the housing from the surface.

17. A method according to claim 16 wherein in said applying step the second part of the length of attachment strip material is adhered along an inner surface of the manually removable portion of the housing to provide the means for restricting adhesion between the second part of the length of attachment strip material and a surface aligned with the first part of the length of attachment strip material.

* * * * *